US006539954B1

(12) United States Patent
Schimmel et al.

(10) Patent No.: US 6,539,954 B1
(45) Date of Patent: Apr. 1, 2003

(54) MACHINE DISHWASHING DETERGENT

(75) Inventors: Günther Schimmel, Erftstadt (DE); Lothar Westermann, Köln (DE); Harald Bauer, Kerpen (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/448,246

(22) Filed: Nov. 24, 1999

(30) Foreign Application Priority Data

Nov. 29, 1998 (DE) ..... 198 54 960

(51) Int. Cl.[7] ..... B08B 3/04; B08B 9/032; C11D 3/08

(52) U.S. Cl. ..... 134/25.3; 134/25.2; 134/39; 134/40; 134/42; 510/220; 510/221; 510/222; 510/232; 510/466; 510/511

(58) Field of Search ..... 510/220–222, 510/232, 466, 511; 134/25.2, 25.3, 39, 40, 42

(56) References Cited

U.S. PATENT DOCUMENTS

| | | | | |
|---|---|---|---|---|
| 4,585,642 A | | 4/1986 | Rieck | 423/333 |
| 4,664,839 A | | 5/1987 | Rieck | 252/175 |
| 4,820,439 A | | 4/1989 | Rieck | 252/135 |
| 4,959,170 A | | 9/1990 | Ulrich et al. | 252/135 |
| 5,308,596 A | | 5/1994 | Kotzian et al. | 423/333 |
| 5,614,161 A | * | 3/1997 | Wilkens et al. | 423/332 |
| 5,710,115 A | * | 1/1998 | Patel et al. | 510/224 |
| 5,880,083 A | | 3/1999 | Beaujean et al. | 510/371 |

FOREIGN PATENT DOCUMENTS

| | | | |
|---|---|---|---|
| DE | 3417649 A1 | | 11/1985 |
| DE | 36 27 773 A1 | | 2/1988 |
| DE | 41 02 743 A1 | | 8/1992 |
| DE | 41 09 247 A1 | | 9/1992 |
| DE | 4142711 A1 | | 6/1993 |
| DE | 44 37 486 A1 | | 4/1996 |
| DE | 44 36 151 A1 | | 5/1996 |
| DE | 19719888 | * | 6/1998 |
| WO | WO 97/31996 | | 9/1997 |
| WO | WO 98/00490 | | 1/1998 |

OTHER PUBLICATIONS

EPO Search Report Aug. 2, 2002.
Front Page of EP 0164514—See AA & AB Above Jun. 14, 1989.
DE 197–19888 with attached English Equivalent Jun. 25, 1998.

* cited by examiner

*Primary Examiner*—Yogendra N. Gupta
*Assistant Examiner*—Brian P. Mruk
(74) *Attorney, Agent, or Firm*—Susan S. Jackson; Scott E. Hanf

(57) ABSTRACT

The invention relates to a liquid to paste machine dishwashing detergent which, in addition to customary machine dishwashing detergent ingredients, comprises a crystalline, layered silicate of the formula $$aA_2O.bBO.cC_2O_3.dD_2O_5.eSiO_2.fH_2O,$$

in which A is an alkali metal and/or hydrogen, B is an alkaline earth metal, C is an element from the third main group of the Periodic Table, and D is an element from the fifth main group of the Periodic Table, and the following also apply: $0 \leqq a \leqq 1$; $0 \leqq b \leqq 0.5$; $0 \leqq c/e \leqq 0.05$; $0 \leqq d/e \leqq 0.25$; $1.9 \leqq e \leqq 4$; $0 \leqq f \leqq 20$.

The invention also relates to a process for the preparation of this machine dishwashing detergent and to its use.

19 Claims, No Drawings

MACHINE DISHWASHING DETERGENT

FIELD OF THE INVENTION

The invention relates to a liquid to paste machine dishwashing detergent, to a process for its preparation and to its use.

DESCRIPTION OF THE RELATED ART

Solid detergents for machine dishwashing are largely supplied in powder or granular form (agglomerates). A serious disadvantage of this type of solid detergents is that there is a strong tendency towards caking or clumping due to the hygroscopicity of individual raw materials when small amounts of moisture enter. This can sometimes lead to a loss in cleaning action and additionally leads the user to believe that the quality is reduced for optical reasons.

Liquid dishwashing detergents, as are used especially in the large-scale commercial sector, are unsuitable for use in automatic household dishwashing machines in the domestic sector primarily because of their insufficiently low viscosity and their high alkalinity, since these products must be characterized as "irritant" and thus represent a great safety risk in the home. In addition, retention of the dishwashing detergent in standard domestic dosing devices is not ensured in most cases.

Standard commercial gelatinous or thixotropic dishwashing detergents comprise greater or lesser amounts of alkali metal silicates, generally in the form of aqueous solutions (water glass), for example in the ratio $Na_2O:SiO_2$ of 1:2 to 1:3.3, which are used to achieve the desired alkalinity and as corrosion inhibitors for the glaze and decoration on porcelain.

It has, however, been found that dishwashing detergents with such decoration and glaze protection have the disadvantage that they form deposits of varying severity on the remainder of the ware, particularly on glasses; they form initially in bright tarnish colors, and subsequently in whitish-opaque bluish adherent films and can only be removed with extremely strong acids, for example a hydrofluoric acid/sulfuric acid mixture. Such dishwashing detergents are therefore unsuitable for use over a prolonged period.

The object of the invention is therefore to provide a non-solid machine dishwashing detergent which, as well as having a good cleaning action, results in less corrosion, in particular on glasses and porcelain plates, and produces fewer deposits compared with the prior art.

SUMMARY OF THE INVENTION

This object is achieved by a machine dishwashing detergent of the type mentioned in the introduction, which, in addition to customary machine dishwashing detergent ingredients, comprises a crystalline, layered silicate of the formula $$aA_2O.bBO.cC_2O_3.dD_2O_5.eSiO_2.fH_2O,$$

in which A is an alkali metal and/or hydrogen, B is an alkaline earth metal, C is an element from the third main group of the Periodic Table, and D is an element from the fifth main group of the Periodic Table, and the following also apply: $0 \leqq a \leqq 1$; $0 \leqq b \leqq 0.5$; $0 \leqq c/e \leqq 0.05$; $0 \leqq d/e \leqq 0.25$; $1.9 \leqq e \leqq 4$; $0 \leqq f \leqq 20$.

DESCRIPTION OF THE PREFERRED EMBODIMENTS

The machine dishwashing detergent preferably comprises from 1 to 50% by weight of the crystalline layered silicate.

The machine dishwashing detergent particularly preferably comprises from 5 to 30% by weight of the crystalline layered silicate.

The crystalline layered silicate is preferably essentially disodium disilicate.

The disodium disilicate is preferably layered crystalline disodium disilicate which consists of at least one of the polymorphic phases of disodium disilicate and of sodium silicates of a nonphyllosilicatic nature.

The layered crystalline disodium disilicate preferably consists of (the following data refer to percentages by weight) from 1 to 40% of alpha-disodium disilicate, from 0 to 50% of beta-disodium disilicate, from 50 to 98% of delta-disodium disilicate and from 0 to 40% of nonphyllosilicatic sodium silicates.

In another embodiment of the invention, the layered crystalline disodium disilicate consists of from 0 to 40% of alpha-disodium disilicate, from 20 to 98% of beta-disodium disilicate, from 0 to 40% of delta-disodium disilicate and from 0 to 50% of nonphyllosilicatic sodium silicates.

In another embodiment of the invention, the layered crystalline disodium disilicate consists of from 20 to 98% of alpha-disodium disilicate, from 0 to 40% of beta-disodium disilicate, from 0 to 50% of delta-disodium disilicate and from 0 to 50% of nonphyllosilicatic sodium silicates.

The definitions of alpha-, beta- and delta-disodium disilicate are known and can be found, for example, in EP 0 164 514.

The crystalline layered silicate in the machine dishwashing detergent according to the invention preferably comprises up to 10 mol % of boron, based on $SiO_2$.

The crystalline layered silicate in the machine dishwashing detergent according to the invention preferably comprises up to 50 mol % of phosphorus, based on $SiO_2$.

The machine dishwashing detergent preferably also comprises at least a surfactant and/or a bleach and/or a rheological additive and/or a dispersant and/or a dispersion medium.

The machine dishwashing detergent preferably comprises, as surfactants, block polymers of long-chain aliphatic alcohols with ethylene oxide or propylene oxide groups, modified fatty alcohol polyglycol ethers, mono- and dialkylsulfates, alkanesulfonates, amine oxides and/or fatty acid methylpolyglycol esters.

The machine dishwashing detergent preferably comprises, as bleach, active chlorine carriers and/or active oxygen carriers.

The machine dishwashing detergent preferably comprises, as rheological additive and/or dispersant, carboxymethylcellulose, polycarboxylates, phosphonates and/or synthetic clays.

The machine dishwashing detergent preferably comprises, as dispersion medium, ethylene glycols, cooligomers/copolymers of propylene oxide and ethylene oxide and/or water.

In addition to the customary machine dishwashing detergent ingredients, the machine dishwashing detergent preferably comprises

- from 2.5 to 50% by weight of crystalline layered sodium disilicate
- from 0 to 20% by weight of surfactant
- from 0 to 40% by weight of sodium tripolyphosphate
- from 0 to 20% by weight of bleach
- from 0.1 to 15% by weight of rheological additive and/or dispersant from 50 to 80% by weight of dispersion medium as other ingredients.

In addition to the customary machine dishwashing detergent ingredients, the machine dishwashing detergent preferably comprises from 5 to 30% by weight of crystalline layered sodium disilicate from 0 to 20% by weight of surfactant from 15 to 30% by weight of sodium tripolyphosphate from 5 to 15% by weight of bleach from 0.1 to 10% by weight of rheological additive and/or dispersant from 50 to 70% by weight of dispersion medium as other ingredients.

In addition to the customary machine dishwashing detergent ingredients, the machine dishwashing detergent preferably comprises from 5 to 30% by weight of crystalline layered sodium disilicate from 5 to 15% by weight of bleach from 0 to 20% by weight of surfactant from 0.1 to 10% by weight of rheological additive and/or dispersant from 30 to 70% by weight of dispersion medium as other ingredients.

In addition to the customary machine dishwashing detergent ingredients, the machine dishwashing detergent preferably comprises from 10 to 40% by weight of crystalline layered sodium disilicate from 0 to 20% by weight of surfactant from 15 to 30% by weight of sodium tripolyphosphate from 0.1 to 15% by weight of rheological additive and/or dispersant from 30 to 70% by weight of dispersion medium as other ingredients.

In addition to the customary machine dishwashing detergent ingredients, the machine dishwashing detergent preferably comprises from 10 to 50% by weight of crystalline layered sodium disilicate from 0 to 20% by weight of surfactant from 0.1 to 15% by weight of rheological additive and/or dispersant from 30 to 70% by weight of dispersion medium as other ingredients.

In the case of the abovementioned preferred compositions, the sodium disilicate is essentially disodium disilicate.

The machine dishwashing detergent according to the invention preferably has corrosion-inhibiting properties.

The machine dishwashing detergent according to the invention particularly preferably has corrosion-inhibiting properties on silicatic surfaces of the ware.

The machine dishwashing detergent according to the invention particularly preferably has corrosion-inhibiting properties, in particular on glasses.

The machine dishwashing detergent according to the invention preferably has increased cleaning action.

The machine dishwashing detergent according to the invention preferably has a lower degree of deposits, in particular on glasses.

The invention likewise relates to a process for the preparation of a machine dishwashing detergent, which comprises firstly dissolving alkali metal carrier in an initial charge of aqueous medium and/or dispersion medium, then mixing in rheological additives and/or dispersants, cooling to room temperature, adding the other components and, at the end of the mixing operation, adding the crystalline layered silicate.

The alkali metal carrier is preferably sodium carbonate, sodium hydroxide, potassium hydroxide and/or water-soluble alkali metal silicates.

The components are preferably surfactants, bleaches, fillers, builders, cobuilders, phosphates, organic complexing agents, foam inhibitors, perfumes and/or dyes and/or optionally other machine dishwashing detergent ingredients.

The invention also relates to the use of the machine dishwashing detergent according to the invention for machine dishwashing.

The layered silicate present in the machine dishwashing detergent according to the invention and having the formula as described above $$aA_2O.bBO.cC_2O_3.dD_2O_5.eSiO_2.fH_2O,$$

in which A is an alkali metal and/or hydrogen, B is an alkaline earth metal, C is an element from the third main group of the Periodic Table and D is an element from the fifth main group of the Periodic Table (and the following also apply: $0 \leqq a \leqq 1$; $0 \leqq b \leqq 0.5$; $0 \leqq c/e \leqq 0.05$; $0 \leqq d/e \leqq 0.25$; $1.9 \leqq e \leqq 4$; $0 \leqq f \leqq 20$), can, in particular, also comprise calcium and magnesium ions.

Other ions which are preferably present are those from the third and fifth main group of the Periodic Table, including in particular boron and phosphorus. This is the case particularly when the layered silicate used is a disodium disilicate as described above and below.

The layered silicate can, however, also be a sodium potassium disilicate in which the sodium to potassium ratio can be varied within a wide range.

In accordance with the invention are likewise layered silicates of the above formula which essentially comprise alkali metals (Li, Na, K) and/or hydrogen, and which comprise small amounts of the abovementioned alkaline earth metals (Be, Mg, Ca, Sr, Ba) and elements from the third main group of the Periodic Table (B, Al, Ga, In, Tl) or from the fifth main group of the Periodic Table (P, As, Sb, Bi).

For the machine dishwashing detergent according to the invention, the abovementioned silicate is used either in a finely ground form, i.e. as powder having an average particle diameter of from 1 to 200 micrometers, or in readily dispersible form, e.g. as compressed granules which disintegrate into microscopically small particles when incorporated into the dishwashing dispersion.

Also suitable are, preferably, readily dispersible compounds of crystalline, layered sodium disilicate with polycarboxylates, as are described in DE-A 197 19 888. Preferred polycarboxylates are homo- or any combinations of copolymers of the monomers acrylic acid and/or maleic acid and/or vinyl acetate and/or methallylsulfonate. The preferred compound of polycarboxylate and crystalline, layered sodium disilicates consists here of from 50 to 98% by weight of said silicate and from 2 to 50% by weight of polycarboxylate.

The other dishwashing detergent components, some of which have already been mentioned above, such as fillers, alkali metal carriers, surfactants, builders, bleaches, rheological additives and dispersants, foam inhibitors and optionally perfumes and dyes and others, can be substances which are already adequately known for these purposes.

The filler used can, for example, be sodium sulfate.

Alkali metal carriers which may be mentioned are the oxides, hydroxides, carbonates and silicates of the alkali metals, preferably sodium carbonate and/or sodium hydroxide and/or potassium hydroxide or water-soluble alkali metal silicates.

Suitable surfactants are chlorine-stable block polymers of long-chain aliphatic alcohols with ethylene oxide or propylene oxide groups or modified fatty alcohol polyglycol ethers or mono- and dialkylsulfates or alkanesulfonates or amine oxides or fatty acid methylpolyglycol esters.

Builders which can be used are monomeric, dimeric, oligomeric or polymeric alkali metal phosphates, preferably pentaalkali metal triphosphate, anhydrous and/or partially hydrated and/or hexahydrate.

Other suitable constituents according to the invention are organic complexing agents, such as mono-, di-, tri-, oligo- and/or polycarboxylic acids, hydroxycarboxylic acids, aminocarboxylic acids and phosphonic acids, preferably in the form of their water-soluble salts. Preferred oligocarboxylic acids are citric, tartaric, maleic acid etc. These are preferably used together with the crystalline layered silicate as compressed granules.

Preferred bleaches are active chlorine carriers, such as sodium dichloroisocyanurate or sodium hypochlorite solution (chlorine bleaching liquor) and active oxygen carriers, such as hydrogen peroxide, alkali metal peroxides, alkaline earth metal peroxides, alkali metal perborate, persulfate, percarbonate, perphosphate and peroxycarboxylic acids and salts thereof, such as dodecaneperoxydicarboxylic acid or magnesium peroxyphthalate.

Bleach activators or bleach catalysts can also be used. A customary bleach activator is tetraacetylethylenediamine. Customary bleach catalysts are complexes of manganese with specific ligands, e.g. derivatives of 1,4,7-triaminocyclononane.

Preferred rheological additives and dispersion auxiliaries are carboxymethylcellulose, polycarboxylates, phosphonates or synthetic clays.

Clays which can be used according to the invention are naturally occurring activated and sometimes modified clay minerals such as bentone types from Rheox, or also synthetic clay minerals such as the Laponite grades from Laporte or synthetic hectorite of the type SKS-21 from Hoechst and synthetic saponite of the type SKS-20 from Hoechst. Other suitable clays are known to the person skilled in the art and can be found in the manufacturer's catalogs.

In the dispersion, dissolved alkali metal silicates or mono-, oligo- and polyphosphates can have a supporting action.

The dispersion carrier (liquid component) used can be a monomeric, oligomeric or polymeric ethylene glycol or cooligomers/copolymers of propylene oxide and ethylene oxide and/or water.

Foam in dishwashers, in most cases caused by foam-producing surfactants or proteinaceous food residues, causes a reduction in cleaning action. It is therefore necessary to add to the dish-washing detergents a foam suppresser or foam dampener, for example chlorine-stable phosphoric esters, such as, for example, triisobutyl phosphate (antifoam TIP from Clariant GmbH), or known silicones, such as the SP grades from Wacker Chemie GmbH.

The abovementioned components can be present in the machine dishwashing detergent according to the invention individually or in mixtures together with the crystalline layered silicates, in particular sodium disilicates (e.g. type SKS-6 from Clariant GmbH).

The consistency of the mixtures according to the invention can be adjusted, depending on the solids content, from low-viscosity/liquid to paste/gelatinous.

Machine dishwashing detergents according to the invention can either contain phosphate or be phosphate-free.

The preparation should preferably be carried out in accordance with the following procedure:

alkali metal carriers, such as, for example, sodium carbonate and/or sodium hydroxide and/or sodium water glass, are firstly dissolved in an initial charge of aqueous medium or another dispersion medium, then rheological additives and/or dispersants (preferably polycarboxylates and/or phosphonic acids) are mixed in, the mixture is cooled to room temperature, and the other components (for example bleach, surfactant and builder (phosphate)) are added. At the end of the mixing operation, the crystalline layered silicate is added.

Admixture preferably takes place with the action of strong shear forces, e.g. with customary dispensers, high-shear mixers from Haake & Kunkel (Ultraturrax(TM)) or impeller, propeller or turbine stirrers.

The machine dishwashing detergents according to the invention are notable for good cleaning capacity even for critical soilings such as burnt-on proteinaceous food residues. In addition, they exhibit high chlorine or active oxygen stability.

The damage to glasses and decorated porcelain plates as a result of deposits and as a result of corrosion is much to very much less than for standard commercial dishwashing, detergents which correspond to the prior art. This can be seen clearly from the examples below.

The machine dishwashing detergents according to the invention are preferably used in domestic dishwashers, but can also be used in commercial dishwashers.

Examples below aim to provide proof of the advantageous properties of the machine dishwashing detergent according to the invention. For comparison purposes, standard commercial dishwashing detergent gels based on phosphate and a test mixture without the addition of crystalline layered silicate (according to the invention) are used.

The pH of the cleaning liquors was then determined directly after the soiling had been filtered off, using a glass electrode.

Machine dishwashing detergents used

| | | |
|---|---|---|
| A | Commercial product 1 | |
| B | Commercial product 2 | |
| C | Commercial product 3 | |
| D | Comparison | |
| | 22.20% by weight | of sodium tripolyphosphate, partially hydrated |
| | 9.00% by weight | of sodium hypochlorite solution (chlorine bleach liquor, 15% active chlorine) |
| | 0.10% by weight | of thickener |
| | 0.04% by weight | of silicone antifoam |
| | 49.50% by weight | of sodium silicate (water glass, 45.5% by weight, silicon dioxide to disodium oxide ratio 2.0) |
| | 1.50% by weight | of sodium alkanesulfonate (® Hostapur SAS 60 from Clariant GmbH) |
| | 0.80% by weight | of sodium polyacrylate |
| | 0.60% by weight | of phosphonate (43% of active substance) |
| | 3.96% by weight | of sodium carbonate |
| | 12.30% by weight | of water |

-continued

| Machine dishwashing detergents used | | |
|---|---|---|
| E | Comparison | |
| | 1.0% by weight | of crystalline layered sodium disilicate (SKS-6 from Clariant GmbH) |
| | 25.0% by weight | of sodium tripolyphosphate granules |
| | 9.0% by weight | of sodium hypochlorite solution |
| | 0.2% by weight | of antifoam |
| | 1.5% by weight | of sodium alkylsulfate |
| | 1.1% by weight | of sodium polyacrylate |
| | 0.3% by weight | of phosphonic acid (60% of active substance) |
| | 0.5% by weight | of sodium hydroxide |
| | 6.0% by weight | of sodium carbonate |
| | 46.5% by weight | of sodium water glass (as in D) |
| | 8.9% by weight | of water |
| F | Invention | |
| | 5.5% by weight | of crystalline layered sodium disilicate (SKS-6 from Clariant GmbH) |
| | 22.2% by weight | of sodium tripolyphosphate, anhydrous |
| | 9.0% by weight | of sodium hypochlorite solution |
| | 0.4% by weight | of antifoam (® Entschäumer TIP from Clariant GmbH) |
| | 49.50% by weight | of sodium silicate (water glass, 45.5% by weight, silicon dioxide to disodium oxide ratio 2.0) |
| | 1.0% by weight | of sodium alkanesulfonate |
| | 2.0% by weight | of sodium polyacrylate |
| | 0.6% by weight | of phosphonic acid (50% of active substance) |
| | 1.0% by weight | of sodium hydroxide |
| | 4.0% by weight | of sodium carbonate |
| | 17.3% by weight | of water |
| G | Invention | |
| | 17.5% by weight | of crystalline layered sodium disilicate/copolymer compound based on acrylic acid/maleic acid (SKS-6 HD from Clariant GmbH) |
| | 20.0% by weight | of sodium tripolyphosphate, anhydrous |
| | 10.0% by weight | of sodium percarbonate |
| | 1.4% by weight | of fatty acid polyglycol ester |
| | 0.6% by weight | of antifoam |
| | 49.50% by weight | of sodium silicate (water glass, 45.5% by weight, silicon dioxide to disodium oxide ratio 2.0) |
| | 0.2% by weight | of bentonite thickener |
| | 18.3% by weight | of water |
| H | Invention | |
| | 10.0% by weight | of crystalline layered sodium disilicate |
| | 10.0% by weight | of sodium perborate monohydrate |
| | 0.1% by weight | of silicone antifoam |
| | 0.9% by weight | of sodium alkanesulfonate |
| | 5.0% by weight | of sodium carbonate |
| | 15.0% by weight | of sodium tripolyphosphate, partially hydrated |
| | 15.0% by weight | of sodium polyphosphate hexahydrate |
| | 1.5% by weight | of bentonite |
| | 42.5% by weight | of water |
| I | Invention | |
| | 30.0% by weight | of crystalline layered sodium disilicate granules |
| | 4.0% by weight | of sodium carbonate |
| | 1.0% by weight | of sodium hydroxide |
| | 0.5% by weight | of phosphonic acid, 50% strength |

-continued

| Machine dishwashing detergents used | |
|---|---|
| 1.0% by weight | of sodium copolymer (Sokalan CP5, BASF) |
| 1.5% by weight | block polymer (Genapol 2909, Clariant GmbH) |
| 1.5% by weight | of protease enzyme |
| 1.5% by weight | of amylase enzyme |
| 10.0% by weight | of sodium perborate monhydrate |
| 49.0% by weight | of water |

EXAMPLE 1

Formation of Deposits on Ware

Using glasses and decorated porcelain plates of varying provenance, composition and shape, the mixtures D to H according to the invention were tested for irreversible damage compared with the commercial products B and C. Porcelain plates and cups, and stainless steel cutlery was used as ballast to make up the prescribed amount of ware of 12 place settings. The test method is in accordance with DIN V ENV 12875-1: April 1998, Mechanische Geschirrspülmaschinenbeständigkeit von Haushaltswaren [Mechanical Diswasher Stability of Household Goods], Part 1. The amount of test detergent added deviates from the draft standard, in each case 40 g of liquid test mixture were added in the washing cycle and 3 ml of rinse-aid were added in the rinse-aid cycle of the test dishwasher.

Method 1: Determination of Deposits on the Ware

After 125 wash cycles, the crockery is assessed visually in the daylight and in a so-called "black box" (black box with diffused artificial light) using the point evaluation table below.

Method 2: Corrosion Determination on Glasses

The number of washing cycles after which the first visible sign of clouding appears is determined.

| Grade | Daylight | "Black box" |
|---|---|---|
| 0 | No clouding | No clouding |
| 1 | No clouding | Very weak clouding/iridescence |
| 2 | No clouding | Weak clouding/iridescence |
| 3 | Very weak clouding/iridescence | Significant iridescence |
| 4 | Weak clouding/iridescence | — |
| 5 | Significant clouding | — |

The arithmetic mean, calculated from the total of the evaluations and number of glasses, gives the grade for the damage which has occurred.

| | Prior Art | | | According to the invention | | | |
|---|---|---|---|---|---|---|---|
| Product | B | C | D | E | F | G | H |
| Method 1 | | | | | | | |
| PH (10 g/l) | 11.5 | 11.7 | 11.3 | 11.4 | 11.7 | 11.4 | 11.2 |
| Grading of the deposits on glasses | 5.0 | 5.0 | 5.0 | 4.0 | 1.0 | 0.5 | 0.0 |

-continued

| Product | Prior Art B | C | D | According to the invention E | F | G | H |
|---|---|---|---|---|---|---|---|
| Method 2 | | | | | | | |
| Number of wash cycles | 20 | 25 | 25 | 30 | 125 | 375 | >400 |

A comparison of machine dishwashing detergents according to the invention and commercial products according to the prior art or the test product according to the prior art with regard to the grades according to Methods 1 and 2 shows that the products according to the invention produce significantly less damage as a result of deposits and as a result of corrosion.

EXAMPLE 2

Cleaning Action

The cleaning action of the machine dishwashing detergents A to I was determined-in accordance with DIN standard draft 44990 and the IKW method in three Miele G 688 SC domestic dishwashers. The test products according to the invention, the comparative product according to the prior art and the commercial products according to the prior art were used in the same amount of 40 g of dishwasher detergent and 3 ml of rinse-aid. Evaluation was carried out after washing by visual assessment of the ware. The test result is given as a percentage (100%=clean). The table below gives the results of the tests and the pH of the wash liquor.

| Dishwashing detergent | A | B | C | D | E | F | G | H | I |
|---|---|---|---|---|---|---|---|---|---|
| pH of wash liquor | 10.1 | 10.6 | 10.6 | 10.4 | 10.5 | 10.5 | 10.5 | 10.2 | 10.5 |
| % cleaning action at 50° C. wash temperature | 79 | 76 | 74 | 76 | 79 | 86 | 89 | 86 | 92 |

The results show that the machine dishwashing detergents according to the invention have a clearly better cleaning action compared with those from the prior art.

What is claimed is:

1. A method for reducing the degree of deposits of a liquid to paste machine dishwashing detergent comprising water glass, the method comprising the incorporation of a crystalline, layered silicate of the formula $$aA_2O.bBO.cC_2O_3.dD_2O_5.eSiO_2.fH_2O,$$

in which A is an alkali metal and/or hydrogen, B is an alkaline earth metal, C is an element form the third main group of the Periodic Table, and D is an element from the fifth main group of the Periodic Table, and the following also apply: $0 \leqq a \leqq 1$; $0 \leqq b \leqq 0.5$; $0 \leqq c/e \leqq 0.05$; $0 \leqq d/e \leqq 0.25$; $1.9 \leqq e \leqq 4$; $0 \leqq f \leqq 20$; into the machine dishwashing detergent, wherein the machine dishwashing detergent comprises from 1 to 50% by weight of the crystalline, layered silicate.

2. The method as claimed in claim 1, wherein the machine dishwashing detergent comprises from 5 to 30% by weight of the crystalline layered silicate.

3. The method as claimed in claim 1, wherein the crystalline layered silicate is disodium disilicate.

4. The method as claimed in claim 3, wherein the disodium disilicate is layered crystalline disodium disilicate which consists of at least one of the polymorphic phases of disodium disilicate and of sodium silicates of a nonphyllosilicatic nature.

5. The method as claimed in claim 3, wherein the layered crystalline disodium disilicate consists of from 1 to 40% of alpha-disodium disilicate, from 0 to 50% of beta-disodium disilicate, from 50 to 98% of delta-disodium disilicate and from 0 to 40% of nonphyllosilicatic sodium silicates.

6. The method as claimed in claim 3, wherein the layered crystalline disodium disilicate consists of from 0 to 40% of alpha-disodium disilicate, from 20 to 98% of beta-disodium disilicate, from 0 to 40% of delta-disodium disilicate and from 0 to 50% of nonphyllosilicatic sodium silicates.

7. The method as claimed in claim 3, wherein the layered crystalline disodium disilicate consists of from 20 to 98% of alpha-disodium disilicate, from 0 to 40% of beta-disodium disilicate, from 0 to 50% of delta-disodium disilicate and from 0 to 50% of nonphyllosilicatic sodium silicates.

8. The method as claimed in claim 1, wherein the crystalline layered silicate comprises up to 10 mol % of boron, based on $SiO_2$.

9. The method as claimed in claim 1, wherein the crystalline layered silicate comprises up to 50 mol % of phosphorous, based on $SiO_2$.

10. The method as claimed in claim 1, wherein the machine dishwashing detergent also comprises at least a surfactant and/or a bleach and/or a rheological additive and/or a dispersant and/or a dispersant medium.

11. The method as claimed in claim 1, wherein the machine dishwashing detergent comprises, as surfactants, block polymers of long-chain aliphatic alcohols with ethylene oxide or propylene oxide groups, modified fatty alcohol polyglycol ethers, mono- and dialkylsulfates, alkanesulfonates, amine oxides and/or fatty acid methylpolyglycol esters.

12. The method as claimed in claim 1, wherein the machine dishwashing detergent comprises, as bleach, active chlorine carriers and/or active oxygen carriers.

13. The method as claimed in claim 1, wherein the machine dishwashing detergent comprises, as rheological additive and/or dispersant, carboxy-methylcellulose, polycarboxylates, phosphonates and/or synthetic clays.

14. The method as claimed in claim 1, wherein the machine dishwashing detergent comprises, as dispersion medium, ethylene glycols, cooligomers/copolymers of propylene oxide and ethylene oxide and/or water.

15. The method as claimed in claim 1, wherein the machine dishwashing detergent in addition to the water glass comprises from 2.5 to 50% by weight of crystalline layered sodium disilicate from 0 to 20% by weight of surfactant from 0 to 40% by weight of sodium tripolyphosphate from 0 to 20% by weight of bleach from 0.1 to 15% by weight of rheological additive and/or dispersant from 50 to 80% by weight of dispersion medium as other ingredients.

16. The method as claimed in claim 1, wherein the machine dishwashing detergent in addition to the water glass comprises from 5 to 30% by weight of crystalline layered sodium disilicate from 0 to 20% by weight of surfactant from 15 to 30% by weight of sodium tripolyphosphate from 5 to 15% by weight of bleach from 0.1 to 10% by weight of rheological additive and/or dispersant from 50 to 70% by weight of dispersion medium as other ingredients.

17. The method as claimed in claim 1, wherein the machine dishwashing detergent in addition to the water glass comprises from 5 to 30% by weight of crystalline layered sodium disilicate from 5 to 15% by weight of bleach from 0 to 20% by weight of surfactant from 0.1 to 10% by weight of rheological additive and/or dispersant from 30 to 70% by weight of dispersion medium as other ingredients.

18. The method as claimed in claim 1, wherein the machine dishwashing detergent in addition to the water glass comprises from 10 to 40% by weight of crystalline layered sodium disilicate from 0 to 20% by weight of surfactant from 15 to 30% by weight of sodium tripolyphosphate from 0.1 to 15% by weight of rheological additive and/or dispersant from 30 to 70% by weight of dispersion medium as other ingredients.

19. The method as claimed in claim 1, wherein the machine dishwashing detergent in addition to the water glass comprises from 10 to 50% by weight of crystalline layered sodium disilicate from 0 to 20% by weight of surfactant from 0.1 to 15% by weight of rheological additive and/or dispersant from 30 to 70% by weight of dispersion medium as other ingredients.

* * * * *